United States Patent [19]

Yamada

[11] Patent Number: 4,798,499

[45] Date of Patent: Jan. 17, 1989

[54] RETAINING PANEL

[75] Inventor: Kunimitsu Yamada, Yokosuka, Japan

[73] Assignees: Kensetsukiso Engineering Co., Ltd.; Okabe Co., Ltd., both of Tokyo, Japan

[21] Appl. No.: 863,307

[22] Filed: May 15, 1986

[30] Foreign Application Priority Data

May 17, 1985 [JP] Japan ..... 60-105447
Jul. 31, 1985 [JP] Japan ..... 60-169126

[51] Int. Cl.[4] ..... E02D 29/02

[52] U.S. Cl. ..... 405/286; 405/258; 405/262; 405/284

[58] Field of Search ..... 405/286, 285, 284, 30, 405/258, 262; 47/33

[56] References Cited

U.S. PATENT DOCUMENTS

| | | | |
|---|---|---|---|
| 936,843 | 10/1909 | Wood | 405/286 |
| 1,278,364 | 9/1918 | Luten | 405/286 X |
| 1,294,556 | 2/1919 | Spelman | 405/286 |
| 2,413,867 | 1/1947 | Easterday | 405/286 |
| 3,073,061 | 1/1963 | Pearson | 47/33 X |
| 3,270,471 | 9/1966 | Middendorf | 52/223 L |
| 3,316,721 | 5/1967 | Heilig | 47/33 X |
| 3,399,437 | 9/1968 | Kelly | 52/223 L X |
| 3,820,343 | 6/1974 | Morren et al. | 405/286 |
| 4,050,254 | 9/1977 | Meheen et al. | 405/286 X |
| 4,521,138 | 6/1985 | Steiner | 405/286 X |
| 4,658,541 | 4/1987 | Haile | 405/284 X |

FOREIGN PATENT DOCUMENTS

| | | | |
|---|---|---|---|
| 3029494 | 4/1981 | Fed. Rep. of Germany | 405/284 |
| 1239424 | 7/1960 | France | 405/286 |
| 2419362 | 11/1979 | France | 405/286 |
| 72920 | 1/1917 | Switzerland | 405/284 |

*Primary Examiner*—Dennis L. Taylor
*Attorney, Agent, or Firm*—James H. Tilberry

[57] ABSTRACT

A concrete revetment is provided which is arcuate in horizontal cross section, and has end portions which are interconnected by a cordal member. The cordal member is adapted to be prestressed by a tension rod to place the cordal member in compressive stress and the arcuate portion of the revetment in tensile stress. The revetment is held in place by anchor means embedded in back-fill on the convex side of the arcuate revetment. A plurality of revetments may be arranged and interlocked horizontally and vertically to form a revetment wall.

5 Claims, 10 Drawing Sheets

A
S
1
2a
15
2
15

RETAINING PANEL

BACKGROUND OF THE INVENTION

This invention relates to the field of art pertaining to stabilization of steep earthen slopes, embankments, and the like. More particularly, this invention relates to the field of art in which man-made revetments are employed for slope stabilization. Specifically, this invention relates to the field of art in which prestressed concrete revetments are employed to stabilize slopes, embankments, and the like.

THE PRIOR ART

Prior art revetments are known to the applicant comprising planar concrete slabs erected to form a vertical wall to stabilize or change the grade of a slope. These slabs are usually anchored at their opposite ends, thereby subjecting the intermediate portions of the slabs to pressure exerted by back-filled soil retained behind the slabs. This pressure places the slabs in tension, resulting in stress failure when the tensile strengths of the slabs are exceeded by the back pressure of the retained soil.

SUMMARY OF THE INVENTION

The subject invention solves the problem of prior art concrete slabs failing in tension due to the build-up of retained soil back pressure. Instead of a planar concrete slab, the subject invention comprises a pre-cast arched slab with a prestressed concrete cordal member connecting the outer edges of the slab. The arch, per se, is inherently stronger and more pressure-resistant than a planar slab, which has relatively low tensile strength. Furthermore soil back pressure places the arch of the subject invention in compression, rather than in tension, thereby exploiting the well known high resistance of concrete to fail in compression. In addition, to guard against arch deflection and consequent lateral edge shift, the arch is subtended and secured against deformation by the prestressed concrete cordal member. The cordal member is prestressed by a steel rod, or similar steel member, which, in a preferred embodiment, is longitudinally passed through the center of the cordal member. Threaded fittings on opposite ends of the steel rod may be used to permit prestress pressure to be applied against the opposite ends of the cordal member, thereby prestressing the cordal member. As soil back pressure tends to flatten the arch, pressures opposite to the prestress pressures in the cordal member will tend to reduce the prestress pressures in the cordal member until the stress in the system is substantially balanced, an optimum condition. With this system of forces and counterforces built into the subject invention, a revetment is provided which is more resistant to failure due to soil back pressure than is the prior art planar concrete slab revetment.

OBJECTS OF THE INVENTION

It is therefore an important object of the invention to provide a concrete revetment which is more resistant to deformation and consequent failure than are prior art concrete revetments.

It is another object of the invention to provide a concrete revetment which is arcuate in conformation, and therefore more resistant to deformation than a planar concrete revetment.

It is yet another object of the invention to prestress a concrete revetment to counterbalance stresses set up in the revetment by soil back pressure.

It is still another object of the invention to provide a concrete revetment in which internal stresses tend to balance each other when the resentment is stressed by external forces.

Another object of the invention is the provision of a concrete revetment which is arched and the arch is stabilized against deformation by a cordal member which subtends the arch.

Yet another object of the invention is the provision of an arched concrete revetment which is prestressed.

It is still another object of the invention to provide an arched concrete revetment including means to selectively prestress the arch of the revetment.

It is yet another object of the invention to provide an arched concrete revetment which is reinforced against breakage during transportation and on-site installation.

It is still another object of the invention to provide a prestressed concrete revetment the surface of which is stain-resistant, and therefore aesthetically improved in appearance, because of the absence of stress cracks on the exterior surface of the revetment through which water would otherwise seep and stain.

The foregoing and other objects, features, and advantages of the invention will become apparent from the description set forth hereinafter when considered in conjunction with the accompanying drawings.

DESCRIPTION OF PREFERRED EMBODIMENTS OF THE INVENTION

Figure 1:
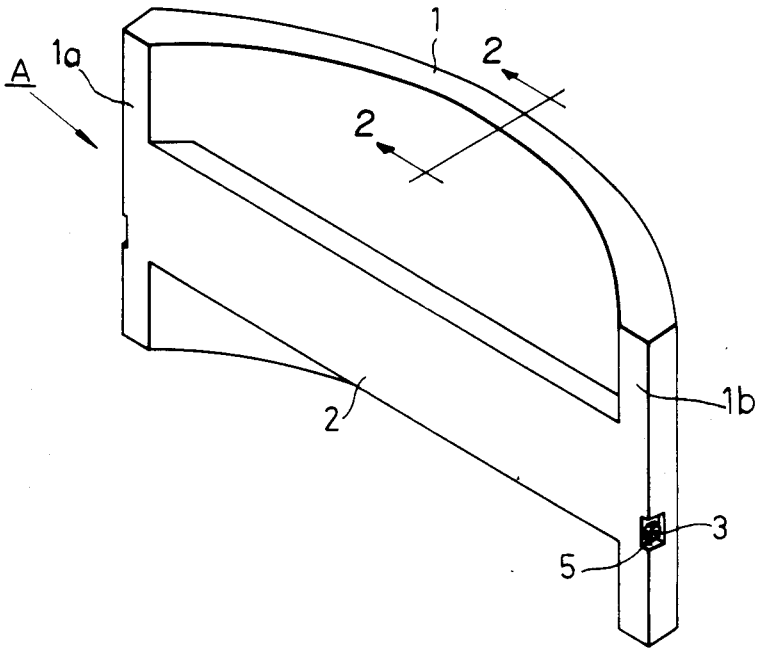
FIG. 1 is a perspective view of a preferred embodiment of the invention.
Figure 2:
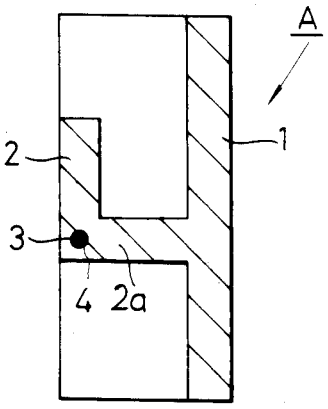
FIG. 2 is an elevational view in section, taken along the line 2—2 of FIG. 1.

Referring now to the drawings in greater detail, and in particular to FIGS. 1 and 2, therein is shown one of the preferred embodiments of the invention. A concrete revetment A comprises an arched portion 1 and a cordal portion 2 integral with arched portion 1 at end portions 1*a* and 1*b*. A steel tension rod 3 is inserted in hole 4 in cordal portion 2 which extends horizontally between end portions 1*a* and 1*b*. The tension rod may be threaded on opposite ends to threadedly receive tension nuts 5 thereon. By tightening nuts 5 on tension rods 3, arched portion 1 is prestressed in tension and cordal portion 2 is prestressed in compression. The prestressing of portions 1 and 2 is selective in that the nuts may be adjustably tightened, more or less, depending on the stresses which the portion 2 will be expected to withstand. It will be noted that the revetment A is further reinforced against stress failure by reinforcing rib 2*a*, which is contiguous with both arched portion 1 and cordal portion 2.

Figure 3:
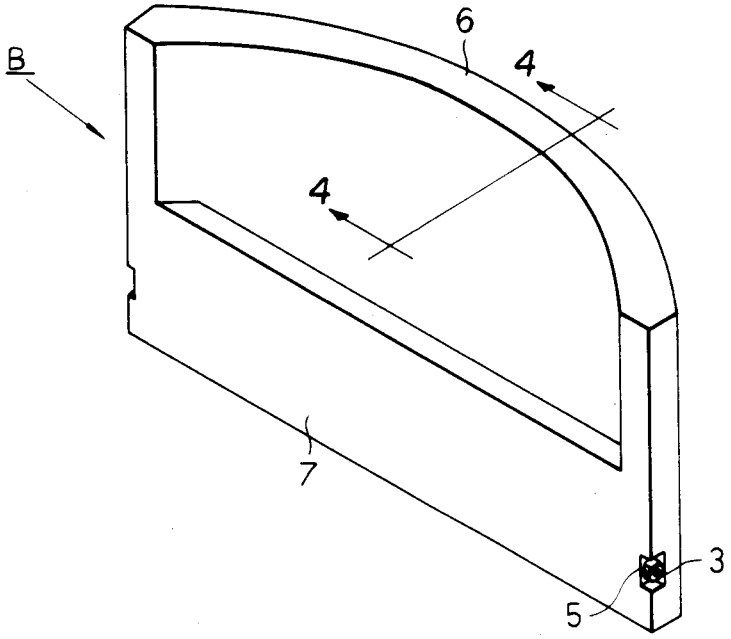
FIG. 3 is a perspective view of a preferred embodiment of the invention.
Figure 4:
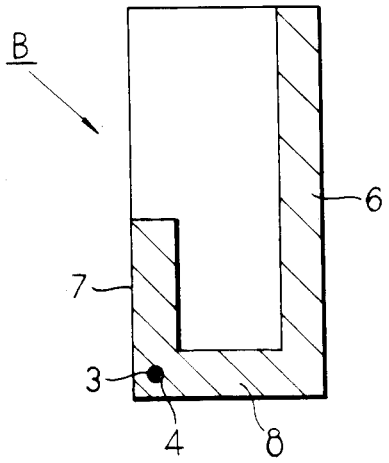
FIG. 4 is an elevational view in section, taken along the line 4—4 of FIG. 3.

FIGS. 3 and 4 disclose another embodiment of the inventive revetment wherein revetment B comprises an arched portion 6, a cordal portion 7, and a reinforcing rib 8 contiguous with arched portion 6 and cordal portion 7. Tension rod 3, tension rod hole 4, and tension nuts 5 are the same as shown in FIGS. 1 and 2.

Figure 5:
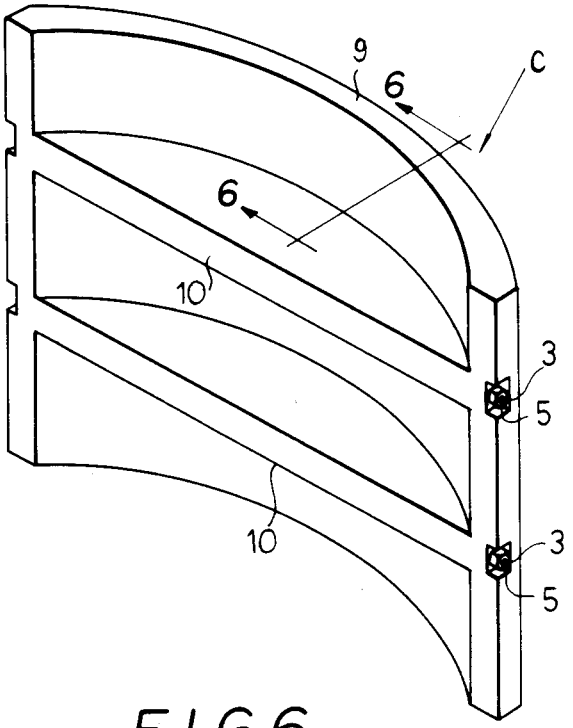
FIG. 5 is a perspective view of a preferred embodiment of the invention.
Figure 6:
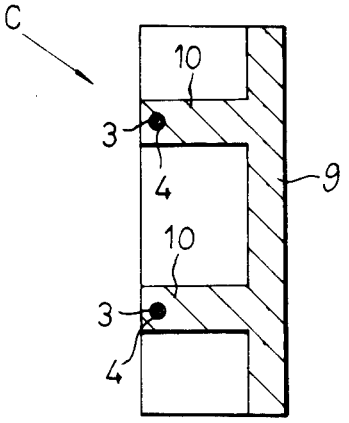
FIG. 6 is an elevational view in section, taken along the line 6—6 of FIG. 5.

In the revetment embodiment C of FIGS. 5 and 6, the two cordal portions 10 are integral with arched portion 9 and combine the functions of the cords and ribs of FIGS. 1–4. Both cordal portions 10 are provided with prestressing rods 3 and nuts 5 in holes 4.

Figure 7:
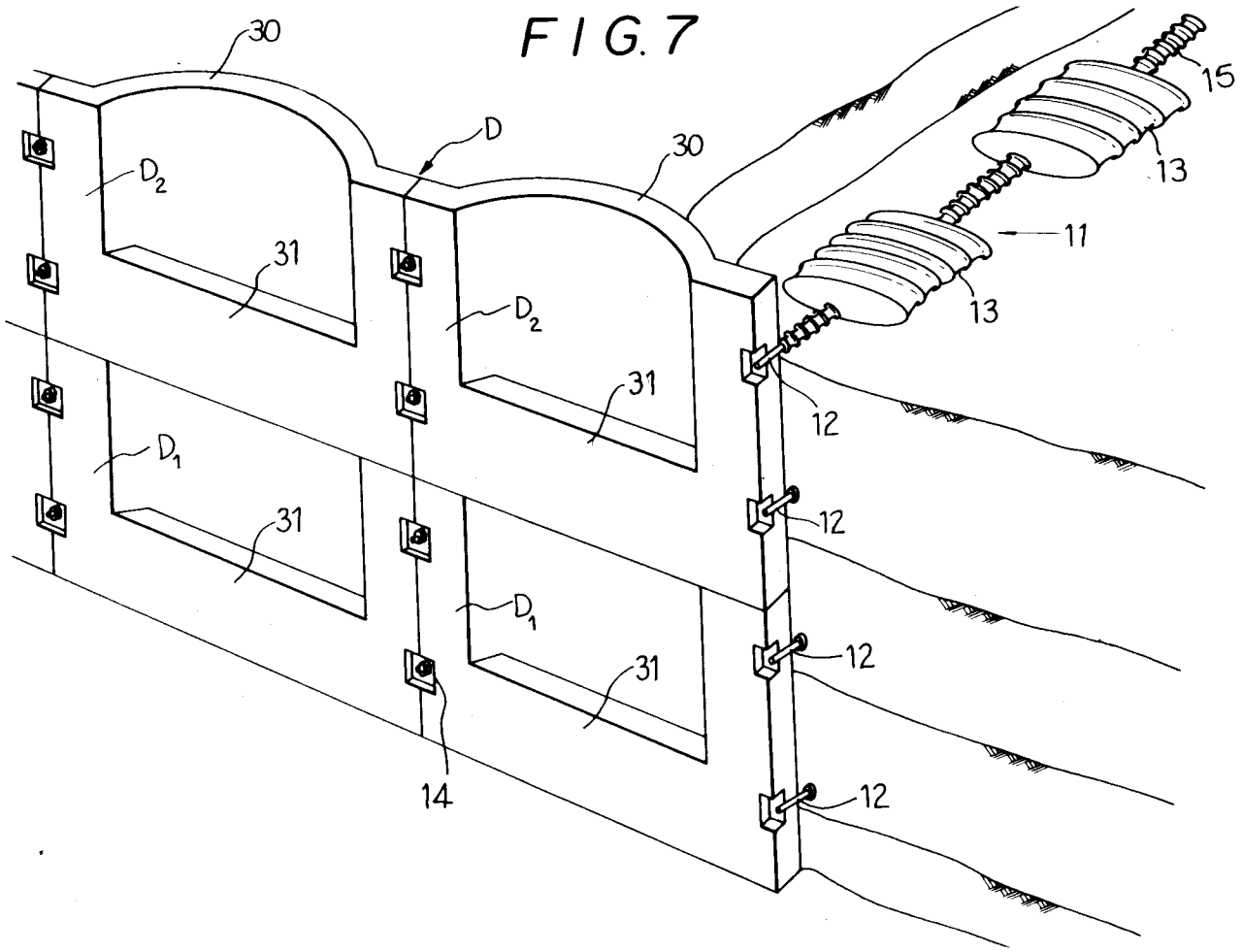
FIG. 7 is a perspective view of another preferred embodiment of the invention shown in stacked array.

Yet another revetment embodiment D is shown in FIG. 7 in combination with anchors 11, anchor rods 12, and anchor deadmen 13, which are embedded in the back fill behind the revetment. A plurality of embodiments D may be arrayed both horizontally (D-1) and vertically (D-2) to provide a retaining wall of any required height and width. The resultant retaining wall is rendered monolithic by the interlocking of revetment anchor rods 12, the free ends of which are provided with lock nuts 14. Otherwise, revetments are comprised of arched portions 30 and cordal portions 31. The prestressing rods 3 and rod holes 4 are not shown in FIG. 7.

Figure 8:
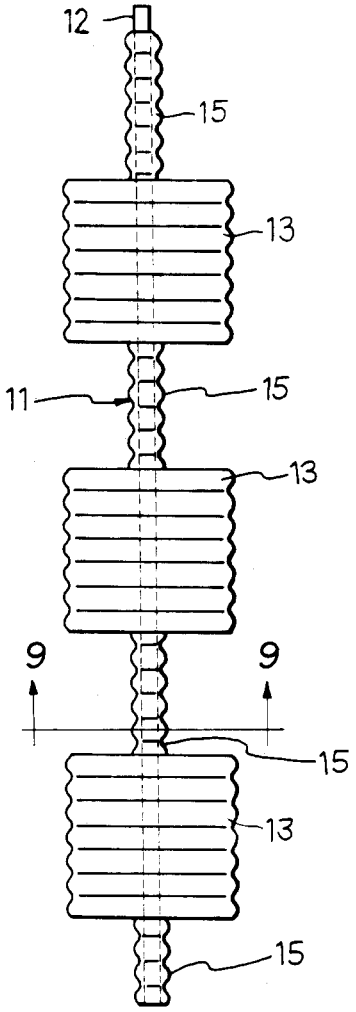
FIG. 8 is a plan view of a preferred anchor for use in combination with the preferred embodiments of the invention.
Figure 9:
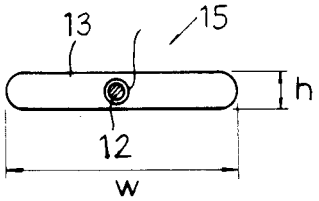
FIG. 9 is a sectional view of the anchor of FIG. 8, taken along the line 9—9 of FIG. 8.

FIGS. 8 and 9 illustrate the anchor rod 12 and anchor deadmen 13 of FIG. 7 in greater detail. Therein is shown the anchor rod 12 intermittently encapsulated in corrugated sheathing 15 between anchor deadmen 13. By spacing the anchor deadmen 13 apart and corrugating the sheathing 15, good gripping contact is obtained between the back fill and the anchors 11.

Figure 10:
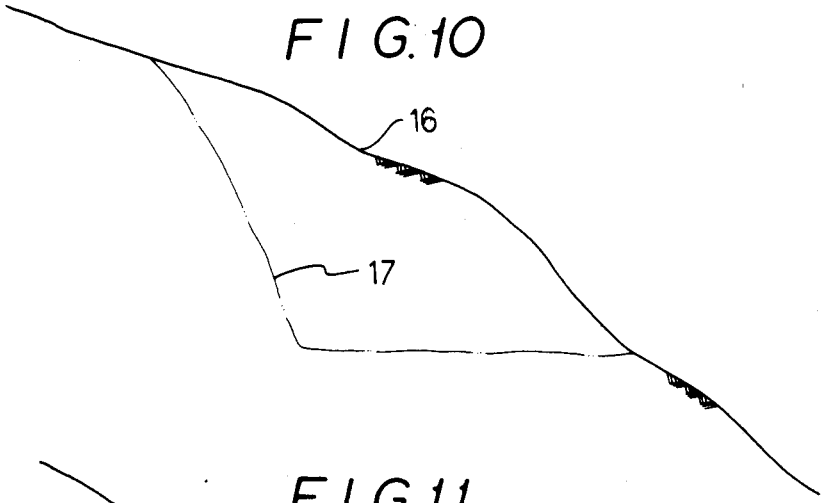
FIG. 10 is a schematic elevation of a slope showing in phantom proposed excavation.
Figure 11:
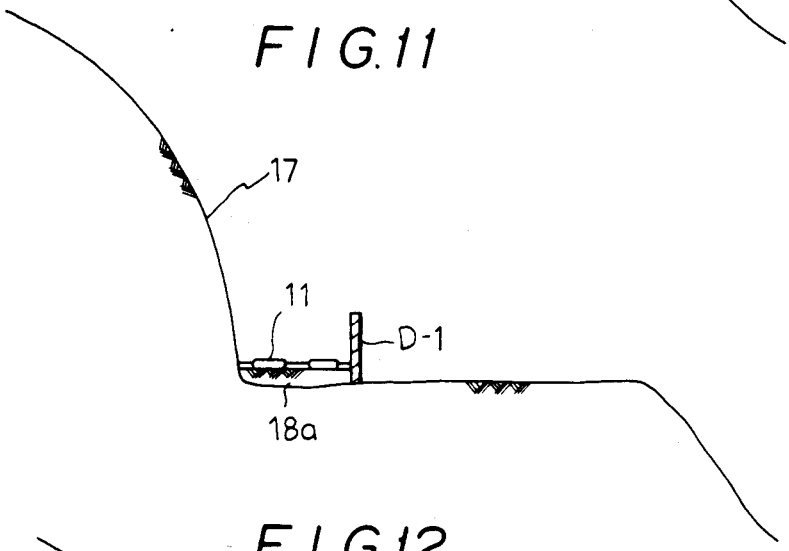
FIG. 11 is a schematic elevation, partially in section, of the slope of FIG. 10 after excavation, showing an inventive revetment and an anchor in place.
Figure 12:
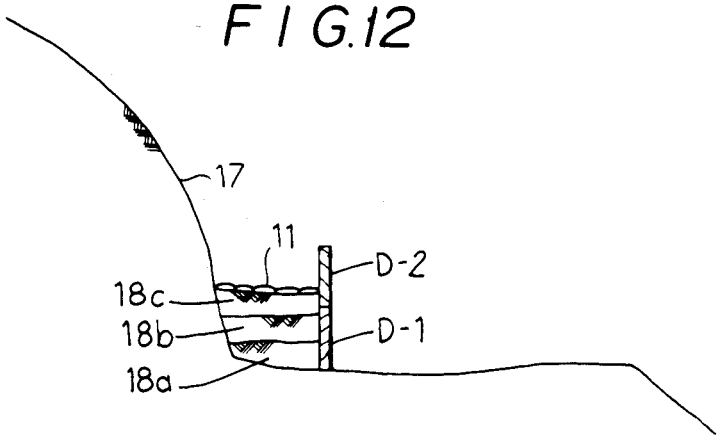
FIG. 12 is a schematic elevation, partially in section, of the slope of FIG. 11, showing back-filling of an additional inventive revetment and an additional anchor.
Figure 13:
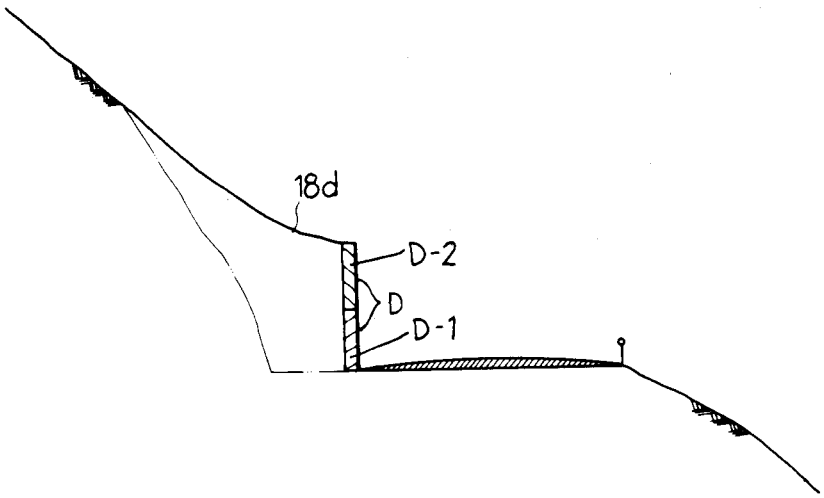
FIG. 13 is a schematic elevation, partially in section, showing a pair of inventive stacked revetments fully back-filled.

FIGS. 10–13 illustrate an application of the invention to stabilize the excavated face of a hillside or the like. FIG. 10 shows the original grade of the hillside at 16 and, in phantom line, the proposed grade 17 after excavation. As shown in FIG. 11, the angle of repose of the excavated hillside is unstable and must be shored up to prevent decay of the new and steeper grade. Thus, a first horizontal row of revetments, D-1 (first tier), are set in place and secured against the back pressure of a first layer of back fill 18*a* by means of anchors 11. In FIG. 12, a second tier of revetments (D-2) has been superposed on the first tier (D-1) and two additional layers of back fill, 18*b* and 18*c*, have been back-filled over additional anchors 11. FIG. 13 is a section through the two-tiered revetment D schematically showing the finished and graded back-fill 18*d*.

Figure 14:
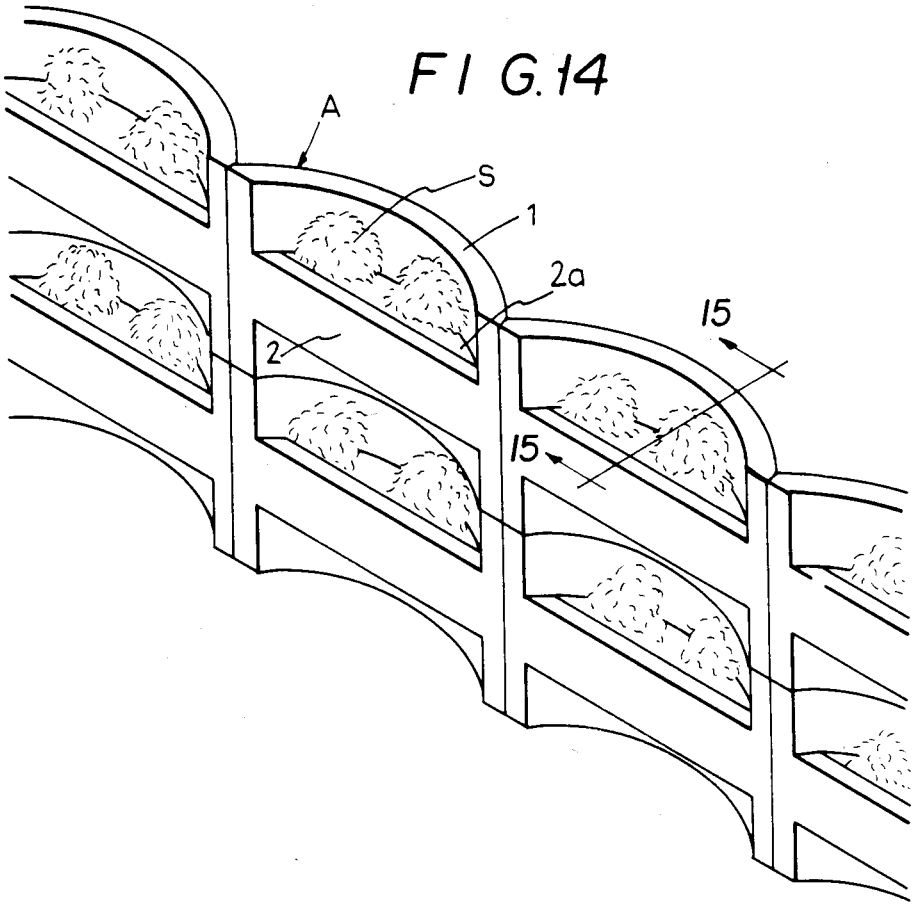
FIG. 14 is a perspective view of a plurality of inventive revetments in vertical and horizontal array.
Figure 15:
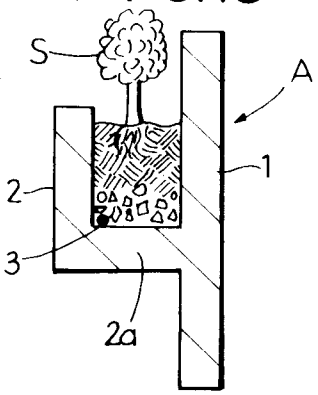
FIG. 15 is an elevation view in section, taken along the line 15—15 of FIG. 14.

In order to enhance the landscape following excavation of the hillside 16 (FIG. 10) and to camouflage, for instance, the revetment A (FIG. 1), shrubs may be potted in the spaces defined by arched portions 1, cordal portions 2, and reinforcing ribs 2*a*, as shown in FIGS. 14 and 15. FIG. 15 also shows an alternative to prestressing rod hole 4 (FIG. 2). Instead of running the rod 3 through hole 4, in FIG. 15, the rod is positioned at the intersection of and parallel to cordal portion 2 and reinforcing rib 2*a*.

Figure 16:
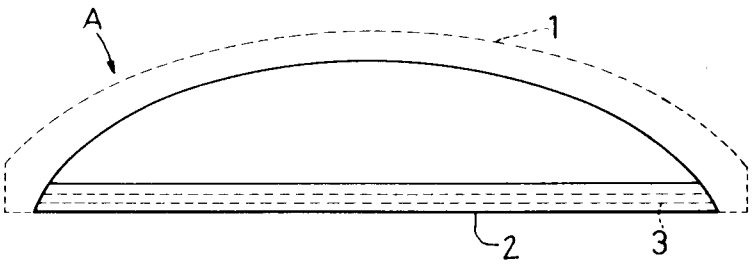
FIG. 16 is a plan view, partially in phantom, showing a prestressed cordal member in association with an inventive revetment.
Figure 18:
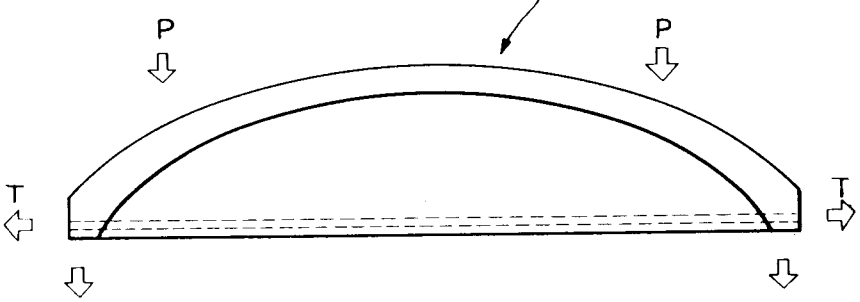
FIG. 18 is a plan view showing stress forces acting on an inventive revetment.

FIGS. 16 and 18 illustrate that arches 1 may be prestressed either with (FIG. 16) or without (FIG. 18) cordal portions 2. FIG. 18 additionally illustrates that back fill pressure P places arch portion 1 in compression while transmitting tension forces T to the opposite ends of tension rod 3 to place tension rod 3 in tension.

Figure 17:
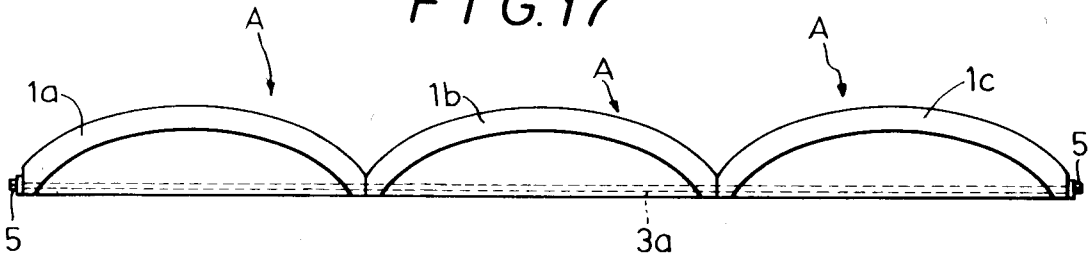
FIG. 17 is a plan view of a plurality of inventive revetments and a cordal member common to all revetments.

FIG. 17 illustrates that a plurality of arches 1*a*, 1*b*, and 1*c* of revetments A may be prestressed with a single rod 3*a* and tension nuts 5.

Figure 19:
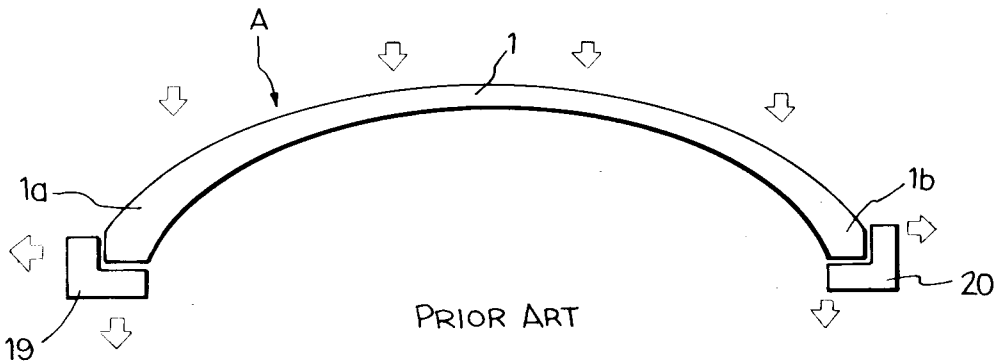
FIG. 19 is a plan view showing resolution of stress forces acting on a prior art revetment.

FIG. 19 illustrates a prior art revetment wherein the opposite end portions 1a and 1b are anchored by anchor posts 19 and 20. Anchor posts 19 and 20 have no capacity to prestress the arch A in tension. Furthermore, if the posts are not adequately anchored, lateral shift could subject the arch A to bending moments, leading to eventual failure by cracking.

Having disclosed the preferred embodiments of the invention, it will occur to those skilled in the art, upon reading the specification in conjunction with a study of the drawings, that certain modifications may be made to the described revetment. However, it is intended that the invention only be limited by the scope of the appended claims.

What is claimed is:

1. For use in stabilizing a steep earthen slope, a concrete revetment comprising a plurality of concrete sections, each of which includes an arcuate member having a convex back face, a concave front face and vertical extremities and a front cordal member interconnecting the vertical extremities of the arcuate member; said cordal member being adapted to encase a tension rod passing longitudinally therethrough; means to tension said tension rod to compress said cordal member to tension said arcuate member; means to stack said sections in vertical rows and to align said sections in horizontal rows, the convex sides of said arcuate members being positioned to face toward said steep earthen slope and means to anchor each said section to said steep earthen slope.

2. The concrete revetment of claim 1, including tension means adapted to prestress an entire horizontal row of cordal members.

3. The concrete revetment of claim 1, wherein each concrete section includes an arcuate member and a plurality of vertically spaced apart cordal members integrally secured to the concave front face of said arcuate member.

4. The concrete section of claim 1, wherein said cordal member comprises a horizontal base having a straight front face and an arcuate convex back face, said back face being integrally secured to the concave face of said arcuate member.

5. The concrete section of claim 4, wherein a potting soil retaining upstanding apron is integrally secured to the said front face of said horizontal base.

* * * * *